United States Patent [19]

Farley

[11] Patent Number: 4,583,430

[45] Date of Patent: Apr. 22, 1986

[54] METAL SHIELDED RETAINING RING

[76] Inventor: D. Gray Farley, 4597 Chelsea Ct., Cypress, Calif. 92008

[21] Appl. No.: 682,678

[22] Filed: Dec. 17, 1984

[51] Int. Cl.[4] ..... B25B 23/16

[52] U.S. Cl. ..... 81/177.85; 403/324; 403/378

[58] Field of Search ..... 81/177.85; 403/378, 403/379, 324, 294, 408

[56] References Cited

U.S. PATENT DOCUMENTS

| | | | |
|---|---|---|---|
| 1,265,341 | 5/1918 | Keller | 81/59.1 |
| 2,110,397 | 3/1938 | Kangas | 403/326 |
| 2,304,038 | 12/1942 | Thompson | 81/121.1 |
| 2,837,381 | 6/1958 | Sarlandt | 403/379 |
| 4,266,453 | 5/1981 | Farley | 81/177.85 |

*Primary Examiner*—James L. Jones, Jr.

*Attorney, Agent, or Firm*—Robert E. Strauss

[57] ABSTRACT

There is disclosed a retaining ring for sockets which are attached to the shaft of a power driver, such as the pneumatic air tools, which is a molded elastomer ring with a diametric, integrally molded pin with a metal sleeve surrounding a portion of the pin. The sockets are provided with a receptacle which receives the shaft end of the driver and flats are provided on the shaft and receptacle to transmit torque. A transverse bore is provided in the shaft end and this receives the pin of the retaining ring. The specific improvement of this invention is a metal sleeve about the portion of the pin which extends across a boundry interface between the shaft end of the driver and the inside wall of the socket member to provide reinforcement to the pin, resisting shearing and abrasive wear.

9 Claims, 7 Drawing Figures

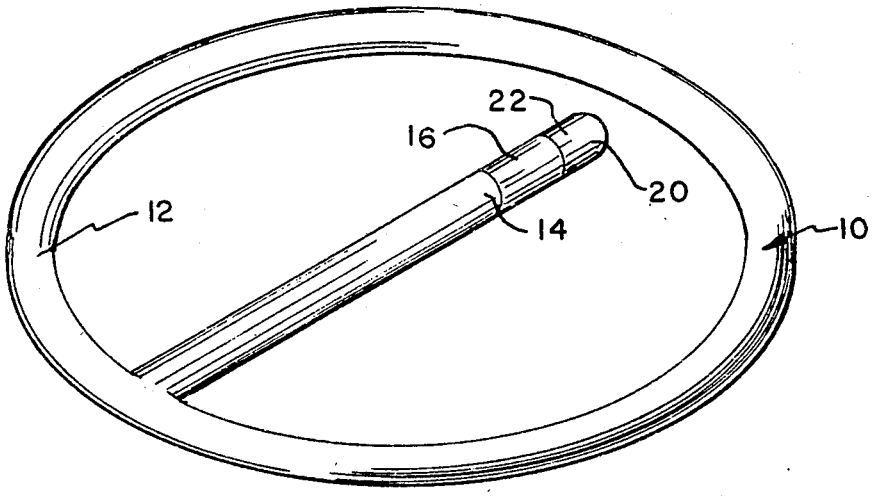
Fig 1
Fig 2
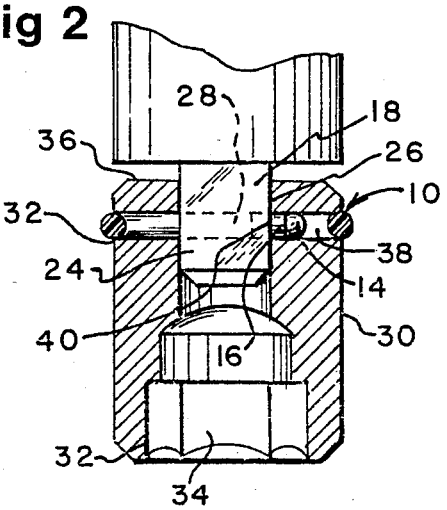
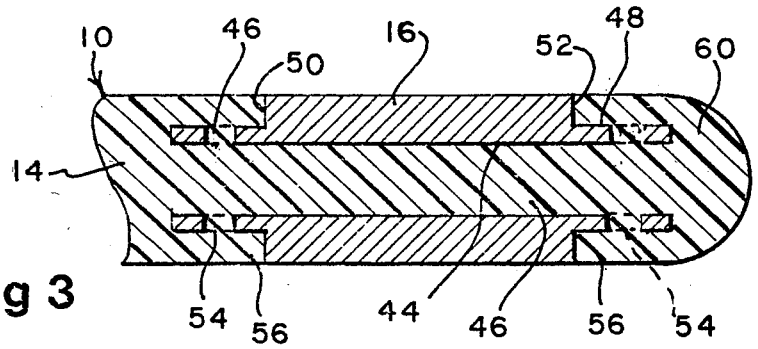
Fig 3

METAL SHIELDED RETAINING RING

BACKGROUND OF THE INVENTION

1. Field Of The Invention

This invention relates to a retaining rings, and in particular to a retaining ring for power driven sockets.

2. Brief Statement Of The Prior Art

For many years, power driven sockets have been secured to the shaft end of a power drive by inserting a steel pin into aligned bores of the socket and the drive shaft. The sockets commonly have a peripheral groove intersecting the aligned bores and a rubber O-ring has been seated in this groove to prevent the accidental dislodgement of the steel pin from the aligned bores.

Since the steel pin and O-ring are separate elements, workmen have assembled the tools without both elements, and have risked injury when the steel pin has been dislodged during use of the tool. Also, the steel pins have jammed in the receiving bores and difficulty has been experienced in extracting these pins.

An attempt has been made to improve this fastening of the sockets to the driver shaft. One example is shown by U.S. Pat. No. 2,304,038 in which a short steel pin was provided with a flat head that was embedded within the rubber O-ring. This fastener has never been successfully marketed, and one apparent difficulty is that the mass of the pin, which is substantial, is off-center and can create an imbalance in the tool and socket. Addiitonally, the pin head is received in a recess of the rubber O-ring and is not molded or positively bonded to the O-ring.

I have recently marketed a fastener having an integrally molded pin which projects from the retainer ring. This retainer ring is the subject of U.S. Pat. No. 4,266,453.

BRIEF STATEMENT OF THE INVENTION

This invention is an improved ring for retaining sockets to the end of the shaft of the socket driver. This invention is a specific improvement of the retaining ring which is the subject of my aforementioned prior patent. While my prior retaining ring has met with commercial success, I have continued my development work and have found that its performance can be improved by the use of a metal sleeve over a short portion of the elastomeric pin which is located at the boundry interface between the driver shaft and the inside socket wall. The metal sleeve over this portion greatly extends the life of the retaining ring by providing substantially increased resistance to failure of the pin by shear and abrasion. The metal sleeve is incorporated on the retainer ring pin during the molding of the retaining ring and is provided with reduced diameter distal necks which are molded into the elastomer of the retaining ring. The interlocking of the sleeve and the ring is further enhanced by bores through the distal necks which receive extruded elastomer during the molding.

BRIEF DESCRIPTION OF THE DRAWINGS

The invention will be described with reference to the figures, of which:

FIG. 1 is a perspective view of the retainer ring of my invention;

FIG. 2 is an elevational sectional view of a socket and driver assembly with the retainer ring of my invention;

FIG. 3 is a partial sectional view of the end of the pin of the retainer ring of my invention;

DESCRIPTION OF PREFERRED EMBODIMENTS

Figure 4:
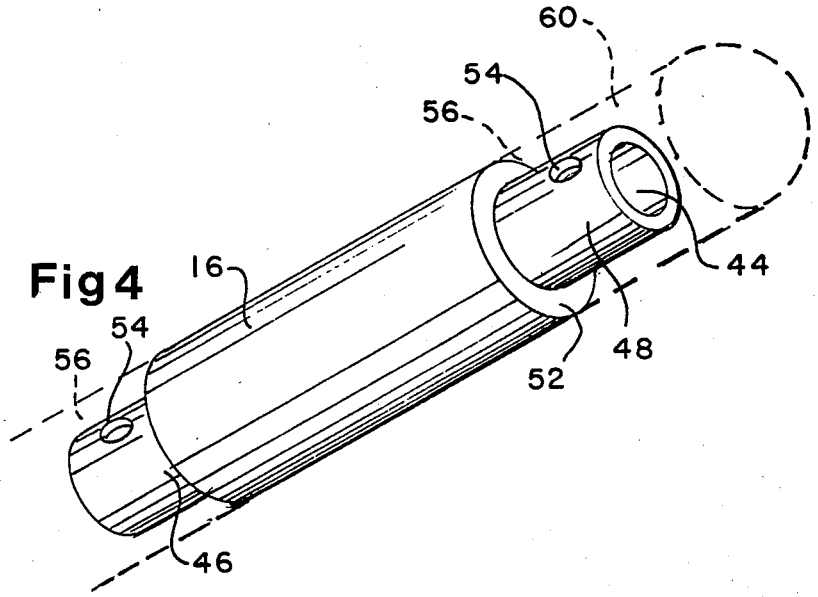
FIG. 4 is a perspective view of the sleeve used in my retainer ring with the outline of the molded elastomeric pin shown in phantom lines.

Referring now to FIG. 1, the invention is a retainer ring 10 having a molded ring 12 with a circular cross-section, similar to that of a conventional O-ring. Projecting from the inside wall of the ring 10 is an integral, dependent pin 14. This pin 14 is preferably formed with a circular cross section, most preferably, of the same diameter as that of the ring 12. Pin 14 extends diametrically across ring 12 and terminates short of interference with the opposite side of ring 12.

A short metal sleeve 16 surrounds a portion of the pin 14, preferably at or near the end 20 of pin 14. Most preferably, the pin 14 is molded within and about the sleeve 16 and has a terminal end portion 22 which projects past the end of sleeve 16. The relative position of the sleeve 16 and its interlocking to the pin 14 of the ring 12 will be described with reference herein to FIGS. 2–4.

The retaining member 10 is formed of a resilient flexible elastomer such as natural and synthetic rubber, e.g., homopolymers and co-polymers of acrylonitrile, butadiene and styrene, neoprene, isoprene, etc. Preferably the elastomeric material used for fabrication of the member 10 is a polyurethane which has a tensile strength at least equal to 5000 psi to provide a long service life.

The assembly of the socket and drive members is shown in sectional view in FIG. 2. The driver has a shaft 18 with an end 24 which is received in receptacle 26 in the drive end 36 of socket member 30. The shaft end 24 has a transverse bore 28. The socket member 30 is conventional in construction with a peripheral groove 32 in its outer cylindrical wall near its drive end 36 and with a transverse bore 38 which extends through the peripheral groove 32. The socket has a through bore which is broached at the drive end 36 to provide internal flats in receptacle 26 which mate with cooperative flats on the shaft 18. Commonly, the shaft 18 has a square cross-section and the receptacle 26 has a mating cross-section. The socket member 30 is counterbored at its socket end 32 and the counterbore is broached to provide the internal flats 34 of the socket member with 6, 8, or 12 points to fit conventional sized nuts.

The retaining member 10 of the invention retains the assembly of the socket member 30 and shaft 18 and seats in the peripheral groove 32 with its integral, molded pin 14 extending through the bore 38 in the opposite sidewalls of the socket 30, and the aligned, transverse bore 28 in the end 24 of shaft 18. The metal sleeve 16, which surrounds the elastomeric pin 14 is located on the portion of pin 14 which extends across the boundry interface 40 between end 24 of shaft 18 and the internal sidewall of receptacle 26 of socket 30. In the preferred embodiment, the metal sleeve extends across only one of these two boundry interfaces.

As shown in FIGS. 3 and 4, the metal sleeve 16 is preferably interlocked to the pin 14 during molding of the retaining member 10. The preferred construction of the sleeve 16 is hollowform with an open interior 44 coextensive its length which receives a molded central core 46 of pin 14. The sleeve 16 has reduced diameter distal necks 46 and 48 to provide metal shoulders 50 and 52. Preferably, each neck has a transverse through bore 54. The reduced diameter necks 46 and 48 are molded into the elastomeric pin 16 with an outer annular portion 56 which surrounds each neck. The elastomeric material extrudes into and through the transverse bores 54 to form integral extensions between the central core 46 and the annular portions 52 surrounding the distal necks 46 and 48.

The pin 14 terminates with a plug end 60 which entirely surrounds the end of sleeve 16. Preferably, sleeve 16 is substantially the same diameter as pin 14 so that the outer annular portions 56 of the elastomeric pin, at each end of the sleeve 16, abut the shoulders 50 and 52 of the sleeve 16, thereby restraining the sleeve 16 against any displacement on the pin 14.

Figure 5:
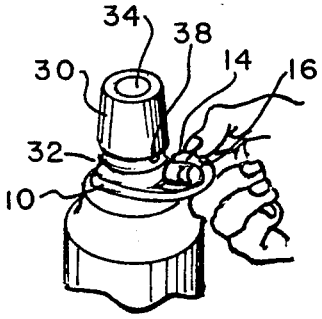
FIGS. 5, 6, and 7 illustrate placement of the retainer ring of my invention onto a socket and shaft assembly.
Figure 6:
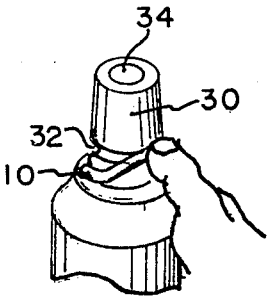
Figure 7:
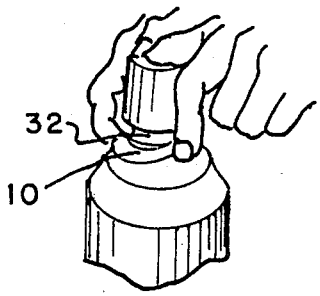

The placement of the retaining member 10 on an assembly of a socket and drive shaft will be described with reference to FIGS. 5–7. As shoun in FIG. 5, the retaining ring 10 is slipped over the end of the shaft 18 and the socket member 30 is placed over the drive shaft. The socket member 30 is rotated to align bore 38 through its sidewalls with bore 28 of the end of shaft 18. The pin 14 is held between the thumb and index-finger and is flexed sufficiently to permit it to be inserted into the aligned bores in the manner shown in FIG. 5. The pin 14 is then pushed completely into the aligned bores, a movement which forces the ring 12 into one side of the peripheral groove 32, as shown in FIG. 6. The ring is finally rolled into position in the peripheral groove 32, by pulling it upwardly until it seats in the groove, as shown in FIG. 7.

The invention provides a number of advantages over the previous retainers. Since it is a single member, it cannot be used improperly without attracting attention. If the pin is not inserted into the aligned bores of the assembly of the socket and drive members, it will be apparent on the outside of the assembly. Similarly, if the ring is not seated in the peripheral groove, it too will be apparent on the outside of the assembly. The metal sleeve 16 greatly extends the useful life of the retainer member, since the metal is located precisely at the boundry interface between the drive shaft and the inside surface of the shaft receptacle in the socket. In this location, the metal sleeve resists shearing forces on the elastomeric pin 14. Additionally, the metal sleeve 16 resists the abrasion and frictional forces applied to the pin at this location.

Since the sleeve is hollowform, it has negligible mass and does not imbalance the assembly. Additionally, the elastomer of pin 14 is extruded into sleeve 16 and the sleeve is thus permanently interlocked to the pin. This interlocking is further enhanced by the reduced-diameter, distal necks 46 and 48 of the sleeve 16 and the transverse bores 54 therein, all of which contribute to a very secure interlock between the pin and the sleeve.

The invention has been described with reference to the presently preferred and illustrated embodiment. It is not intended that the invention be unduly limited by this disclosure of presently preferred embodiments. Instead, it is intended that the invention be defined by the means, and their obvious equivalents, set forth in the following claims.

I claim:

1. A retaining ring to retain a power-driven socket to the end of a shaft wherein the shaft has a transverse bore and at least one flat surface, and wherein the socket has a receptacle for the end of said shaft with at least one flat surface that mates with said flat surface on said shaft and is separated therefrom by a boundry interface, a through bore extending through the side walls of said socket to align with said transverse bore of said shaft, and a peripheral groove in the outer wall of said socket which intersects said transverse bore, which comprises:

(a) a molded elastomeric ring having a diameter to be resiliently received in said peripheral groove;

(b) a molded, integral pin dependent from the inside and extending across said ring;

(c) a short metal sleeve surrounding a portion of said pin which bridges across one boundry interface between the socket and the shaft; and (d) integrally molded interlock means carried by said pin to restrain said sleeve against displacement thereon.

2. The retaining ring of claim 1 wherein said metal sleeve is filled with an integrally molded core of said elastomeric pin.

3. The retaining ring of claim 1 wherein said metal sleeve has an outer diameter substantially equal to the outer diameter of said elastomeric pin and said elastomer pin is molded about said sleeve, filling said sleeve and forming at least one annular shoulder abutting an end of said sleeve, thereby functioning as said integrally molded interlock means.

4. The retaining ring of claim 3 wherein said metal sleeve has at least one distal neck of reduced outer diameter which is received within said elastomeric pin, thereby providing a portion of said pin which surrounds said distal neck of said sleeve.

5. The retaining ring of claim 4 wherein said the distal neck of said metal sleeve has a transverse bore and the elastomer of said pin extrudes through said transverse bore, integrally bridging between the core of said pin and the portion of said pin which surrounds said distal neck.

6. The retaining metal sleeve of claim 4 wherein said pin has a reduced diameter neck at each of its ends, and said necks are each surrounded by outer portions of said elastomer.

7. The retaining metal sleeve of claim 5 wherein said pin has a reduced diameter neck at each of its ends with a transverse bore through each of the necks and each transverse bore receives a molded extrusion of said elastomer to bridge between the core of said pin and the outer portion of said elastomer.

8. The retaining ring of claim 1 wherein said pin is molded with a center core extending through said sleeve and terminating in a distal plug beyond the end of said sleeve.

9. The retaining ring of claim 8 wherein said sleeve has an outer diameter substantially equal to the outer diameter of said pin and said plug, whereby said pin and said plug form annular shoulders at opposite ends of said pin to capture said pin therebetween.

* * * * *

UNITED STATES PATENT AND TRADEMARK OFFICE

CERTIFICATE OF CORRECTION

PATENT NO. : 4,583,430

DATED : April 22, 1986

INVENTOR(S) : D. Gray Farley

It is certified that error appears in the above—identified patent and that said Letters Patent is hereby corrected as shown below:

Claims 6 and 7, line 1, change "metal sleeve" to --ring--.

Claims 6 and 7, line 2, change "pin" to --metal sleeve--.

Signed and Sealed this

Fifteenth Day of November, 1988

*Attest:*

DONALD J. QUIGG

*Attesting Officer*

*Commissioner of Patents and Trademarks*